United States Patent [19]

Akiyama et al.

[11] Patent Number: 4,678,178

[45] Date of Patent: Jul. 7, 1987

[54] SHEET MATERIAL CONVEYING DEVICE

[75] Inventors: Kazunori Akiyama, Takatsuki; Arihiro Tsunoda, Sakai; Satoshi Tanaka, Yao, all of Japan

[73] Assignee: Mita Industrial Co., Ltd., Osaka, Japan

[21] Appl. No.: 705,804

[22] Filed: Feb. 26, 1985

[30] Foreign Application Priority Data

Feb. 29, 1984 [JP] Japan ..... 59-29973[U]
Oct. 30, 1984 [JP] Japan ..... 59-164871[U]

[51] Int. Cl.[4] ..... B65H 9/14

[52] U.S. Cl. ..... 271/242; 271/246; 271/266; 271/273; 198/624; 198/781

[58] Field of Search ..... 271/242, 245, 246, 292, 271/273, 274, 266, 22; 198/624, 781

[56] References Cited

U.S. PATENT DOCUMENTS

| | | | |
|---|---|---|---|
| 1,067,805 | 7/1913 | Diescher | 198/624 |
| 4,006,815 | 2/1977 | Werntz | 198/781 X |
| 4,266,660 | 5/1981 | Herman | 198/781 |
| 4,337,935 | 7/1982 | Sawada et al. | 271/242 X |
| 4,505,381 | 3/1985 | Major | 198/781 |

FOREIGN PATENT DOCUMENTS 57-86849 5/1982 Japan .

OTHER PUBLICATIONS

Clark et al., *Xerox Disclosure Journal*, "Weighed Pinch Rolls", vol. 2, #6, 12/77, pp. 61-62.

*Primary Examiner*—Duane A. Reger
*Assistant Examiner*—Matthew C. Graham
*Attorney, Agent, or Firm*—Wenderoth, Lind & Ponack

[57] ABSTRACT

A sheet material conveying device includes a feed roller assembly and a temporary hampering device disposed downstream of the roller assembly. The conveying device includes a driven shaft to be rotated by a driving source and a plurality of driven rollers mounted on the shaft. The driven rollers comprise at least one positively driven roller having a non-slip rotary connection with the driven shaft and at least one negatively driven roller having a slip connection with the driven shaft. The positively driven roller is mounted on the driven shaft so as to be rotated continuously with rotation of the driven shaft. The negatively driven roller has an inside diameter larger than the outside diameter of the driven shaft and is rotatably mounted on the driven shaft. When the forward movement of the sheet material fed by the feed roller assembly is hampered by the temporary hampering device, the rotation of the negatively driven roller is stopped by the resistance of the sheet material exerted on the negatively driven roller in spite of the continued rotation of driven shaft.

10 Claims, 9 Drawing Figures

SHEET MATERIAL CONVEYING DEVICE

FIELD OF THE INVENTION

This invention relates to a sheet material conveying device which can be conveniently applied to an electrostatic copying machine or the like. More specifically, it relates to a sheet material conveying device comprising a feed roller assembly for feeding a sheet material and a temporary hampering means disposed downstream of the feed roller assembly for temporarily hampering the advancing of the sheet material fed by the feed roller assembly.

DESCRIPTION OF THE PRIOR ART

As is well known, an electrostatic copying apparatus or the like includes a sheet material conveying system for conveying a sheet material, which may be ordinary paper, through a predetermined passage. The sheet material conveying system includes means for delivering the sheet material manually or automatically and a sheet material conveying device for conveying the sheet material delivered from the sheet material delivering means. The sheet material conveying device generally comprises a feed roller assembly and a temporary hampering means disposed downstream of the feed roller assembly. The feed roller assembly has a driven roller to be rotated continuously and a cooperating follower roller. The temporary hampering means is generally comprised of a selective operating roller assembly having a driven roller to be selectively rotated and a cooperating follower roller. In the sheet material conveying device described above, a sheet material delivered manually or automatically from the sheet material delivering means is nipped by the continuously rotated driven roller and the follower roller in the feed roller assembly and fed to the temporary hampering means. The leading edge of the sheet material is caused to abut against the nipping position between the driven roller in the inoperative state and the follower roller in the selective operating roller assembly constituting the temporary hampering means. As a result, the forward movement of the sheet material is hampered or interrupted. When the sheet is inclined with its leading edge being substantially non-perpendicular, but inclined, to the conveying direction, the inclined condition of the sheet material is corrected. Thereafter, the rotation of the driven roller in the selective operating roller assembly is started in synchronism with, for example, the scan-exposure of a document to be copied, or the rotation of a rotating drum on which a toner image corresponding to the document is to be formed. Consequently, the conveying of the sheet material which has temporarily been suspended is resumed. The temporary hampering means comprised of the selective operating roller assembly, therefore, performs the dual function of correcting the inclination of the sheet material and of conveying the sheet material synchronously.

The conventional sheet material conveying device described above, however, has the following problem or defect to be solved or removed. While the advancing of the sheet material is hampered by the temporary hampering means, the driven roller in the feed roller assembly is kept rotating. Thus, a slipping condition is continuously maintained between the driven roller and the sheet material, and tends to soil one surface of the sheet material. This soiling of one surface of the sheet material is not so significant when a copied image is formed only on the other surface of the sheet material. But it constitutes a serious problem when the copied image is formed on both surfaces of the sheet material. Furthermore, when the sheet material has a low degree of stiffness, the aforesaid slipping condition is not generated between the driven roller in the feed roller assembly and the sheet material. Thus, in spite of the hampering of the advancing of the sheet material by the temporary hampering means, the feeding of the sheet material by the feed roller assembly is continued. This frequently causes creases in the sheet material between the feed roller assembly and the temporary hampering means, and may result in jamming.

The above problems may be solved by selectively controlling the rotation of the driven roller in the feed roller assembly and stopping the rotation of the driven roller in the feed roller assembly immediately after the advancing of the sheet material has been hampered by the temporary hampering means. To achieve this, it is necessary to provide a clutch means for controlling driving linking of the driven roller in the feed roller assembly with a driving source, and a control means for the clutch means. This greatly increase the cost and size of an electrostatic copying machine and the like.

SUMMARY OF THE INVENTION

It is a primary object of this invention to provide a novel and improved sheet material conveying device which can circumvent or considerably reduce the aforesaid soiling of one surface of a sheet material without exerting any significantly deleterious effect on the cost and size of an electrostatic copying apparatus and the like and also without adversely affecting the inclination correcting function and the synchronously conveying function of the temporary hampering means.

Another object of this invention is to provide a novel and improved sheet material conveying device in which jamming of a sheet material can be surely avoided even when the sheet material has low stiffness.

According to this invention, there is provided a sheet material conveying device comprising a feed roller assembly for feeding a sheet material and a temporary hampering means disposed downstream of the feed roller assembly for temporarily hampering the forward movement of the sheet material feed by the feed roller assembly, said feed roller assembly including a driven shaft to be rotated by a driving source, an opposing shaft spaced from the driven shaft, a plurality of driven rollers mounted on the driven shaft and at least one follower roller mounted on the opposing shaft and being adapted to feed the sheet material while nipping it between the driven rollers and the follower roller. The driven rollers include at least one positively driven roller mounted on the driven shaft so as to positively rotated incident to the rotation of the driven shaft and at least one negatively driven roller having an inside diameter larger than the outside diameter of the driven shaft and mounted rotatably on the driven shaft, whereby when the forward movement of the sheet material fed by the feed roller assembly is hampered by the temporary hampering means, the rotation of the driven roller is stopped by the resistance of the sheet material exerted on the driven roller in spite of the driven shaft being rotated. As employed herein, the term "positively driven roller" is employed to refer to a roller having a non-slip rotary connection with the driven shaft to always rotate therewith, and the term "negatively driven roller" refers to a roller having a slip rotary connection with respect to the driven shaft.

DETAILED DESCRIPTION OF PREFERRED EMBODIMENTS

The present invention will be described in detail below with reference to the accompanying drawings.

Figure 1:
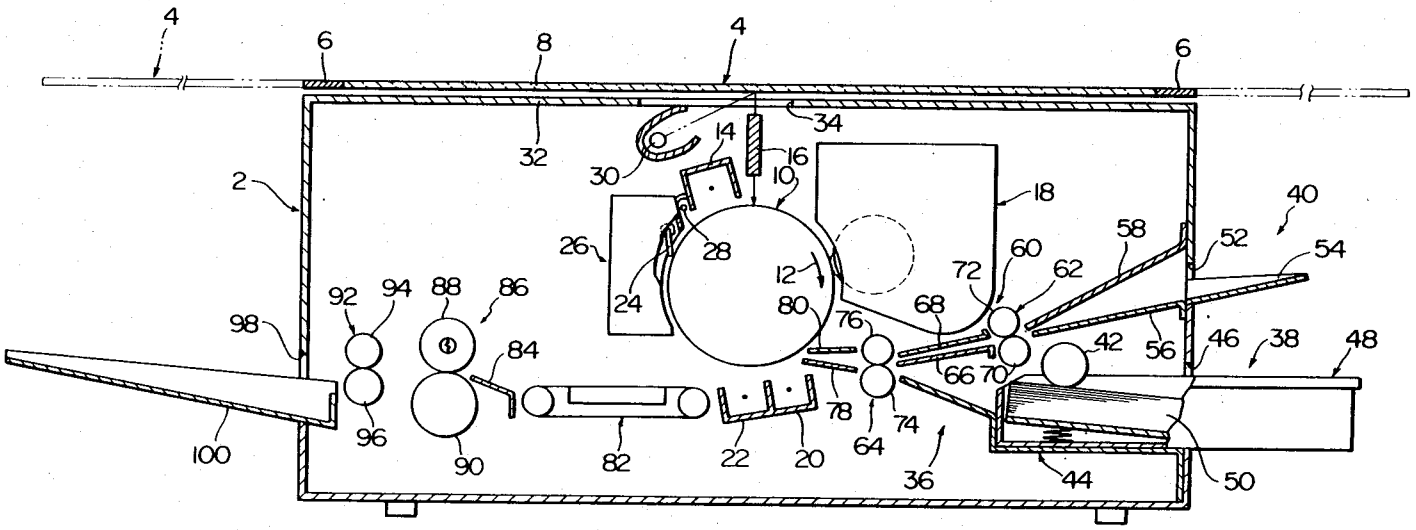
FIG. 1 is a simplified sectional view showing an electrostatic copying machine to which one embodiment of the sheet material conveying device constructed in accordance with this invention is applied.

FIG. 1 shows one example of an electrostatic copying machine to which one embodiment of the sheet material conveying device constructed in accordance with this invention is applied.

The illustrated copying machine has a nearly parallelpipedal housing 2. On the upper surface of the housing 2 is mounted a document placing means 4 for free movement in the left-right direction in FIG. 1. The document placing means 4 has a supporting frame 6 and a transparent plate 8 fixed thereto. A document (not shown) to be copied is placed on the transparent plate 8, and the transparent plate 8 and the document on it are covered with a document cover (not shown) mounted on the supporting frame 6 and adapted to be freely opened and closed. A rotating drum 10 having a photosensitive material on its peripheral surface is rotatanbly disposed nearly centrally in the housing 2. Around the rotating drum 10 to be rotated in the direction of an arrow 12 are disposed and charging corona discharge device 14, an optical unit 16, a magnetic brush developing device 18, a transfer corona discharge device 20, a peeling corona discharge device 22, a cleaning device 26 having a cleaning blade 24, and a charge eliminating lamp 28 in this sequence in the rotating direction of the rotating drum 10. A document illuninating lamp 30 is disposed in relation to the optical unit 16. The document illuminating lamp 30 illuminates a document (not shown) on the transparent plate 8 of the document placing means 4 through an opening 34 formed in the upper plate 32 of the housing 2. The optical unit 16 is comprised of many vertically extending elongated optical elements (for example, rod-like lenses sold under the trade name "Selfoc Microlenses" by Nippon Sheet Glass Co., Ltd.) aligned in the front-rear direction (the direction perpendicular to the sheet surface in FIG. 1), and projects the reflecting light from the document onto the peripheral surface of the rotating drum 10 as shown by the arrow in FIG. 1.

A sheet material conveying system shown generally at 36 is disposed in nearly the lower half of the housing 2. At one end (the right end in FIG. 1) of the sheet material conveying system 36 are provided a cassette-type automatic sheet material delivering means 38 for automatically delivering the sheet material and a manual sheet material delivering means 40 above the means 38 for manually delivering the sheet material. The automatic sheet material delivering means 38 is comprised of a cassette receiving section 44 having a delivery roller 42 provided therein and a copying paper cassette 48 to be loaded in the cassette-receiving section 44 through an opening 46 formed in the right end wall of the housing 2. By the action of delivery roller 42 to be selectively rotated, sheet material are delivered one by one from a sheet material stack 50 held in the paper cassette 48. The sheet material may usually be paper. The manual sheet material delivering means 40 is comprised of a receiving stand 54 extending outwardly from an opening 52 formed in the right end wall of the housing 2 and a lower guide plate 56 and an upper guide plate 58 disposed within the housing 2 in relation to the receiving stand 54. To deliver a sheet material such as ordinary paper by hand, the sheet material is positioned on the receiving stand 54 and then advanced through the opening 52 and the space between the guide plates 56 and 58.

Downstream of the guide plates 56 and 58 is disposed one embodiment of the sheet material conveying device improved in accordance with this invention. The sheet material conveying device shown generally at 60 has a feed roller assembly 62, a temporary hampering means 64 disposed downstream of the feed roller assembly 62, and a lower guide plate 66 and an upper guide plate 68 disposed therebetween. The feed roller assembly 62 comprises driven rollers 70 and cooperating follower rollers 72. The temporary hampering means 64 comprises driven rollers 74 to be selectively rotated and cooperating follower rollers 76. The sheet material conveying device 60 will be described in greater detail hereinafter.

A lower guide plate 78 and an upper guide plate 80 are provided downstream of the temporary hampering means 64. With reference to FIG. 1, there are disposed on the left side of the rotating drum 10 a conveying belt mechanism 82, a guide plate 84, a fixing device 86 having a driven hot roller 88 and a follower roller 90, a discharge roller assembly 92 having a driven roller 94 to be continuously rotated and a follower roller 96, and a receiving tray 100 extending outwardly through an opening 98 formed in the left end wall of the housing 2.

In the above electrostatic copying machine, while the rotating drum 10 is rotated in the direction of arrow 12, the charging conona discharge device 14 charges the photosensitive material to a specific polarity substantially uniformly. The image of a document is then projected onto the photosensitive material through the optical unit 16 (at this time, the document placing means 4 makes a scan-exposure movement to the right in FIG. 1 from its start-of-scan position shown by a two-dot chain line 4 in FIG. 1). As a result, a latent electrostatic image corresponding to the document is formed on the photosensitive material. Then, the developing device 18 applies toner particles to the latent electrostatic image on the photosensitive material to develop it into a toner image. In the meantime, the leading edge of the sheet material automatically delivered from the automatic sheet material delivering means 38 or the leading edge of the sheet material delivered by hand from the manual sheet material delivering means 40 and fed by the action of the feed roller assembly is caused to abut against the nipping position between the driven rollers 74 in the inoperative state and the follower rollers 76. Consequently, the forward movement of the sheet material is hampered. When the leading edge of the sheet material is not substantially perpendicular to the conveying direction but is inclined thereto, this inclined condition of the sheet material is corrected. Then, in synchronism with the rotation of the rotating drum 10, the rotation of the driven rollers 74 in the inoperative state is started. Consequently, the conveying of the sheet material which has temporarily been suspended is resumed, and the sheet material is advanced through the space between the guide plates 78 and 80 and brought into contact with the surface of the photosensitive material on the rotating drum 10. The toner image on the photosensitive material is transferred to the sheet material by the action of the transfer corona discharge device 20, and then the sheet material is peeled from the photosensitive material by the action of the peeling corona discharge device 22. The sheet material having the toner image transferred thereto is conveyed by the action of the conveying belt mechanism 82 and set to the fixing device 86. The sheet material having the toner image fixed by the fixing device 86 is discharged onto the receiving tray 100 by the action of the discharge roller assembly 92. Meanwhile, the rotating drum 10 continues to rotate and the residual toner particles are removed from the photosensitive material by the action of the cleaning device 26. Then, the residual charge on the photosensitive material is erased by the action of the charge eliminating lamp 28.

The structure and operation of the illustrated copying machine excepting the sheet material conveying device 60 are known. The illustrated copying machine is only one example of structure with which the sheet material conveying device constructed in accordance with this invention may be employed. Accordingly, a detailed description of the structure and operation of the copying machine excepting the sheet material conveying device 60 is omitted in the present specification.

Figure 2:
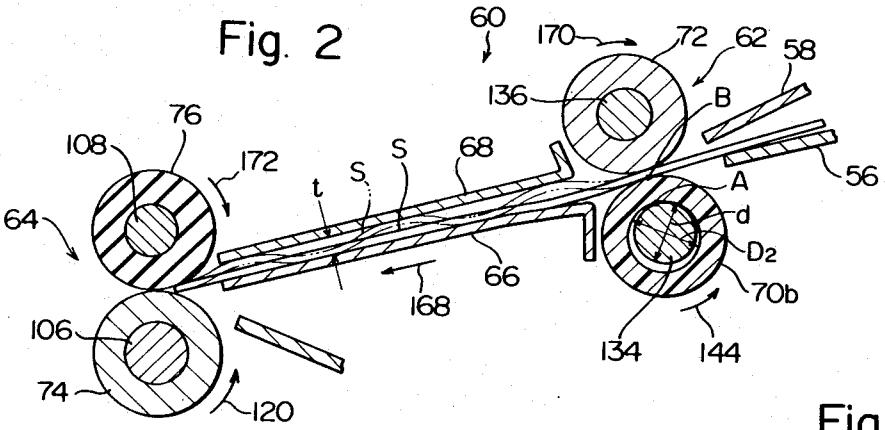
FIG. 2 is a sectional view showing the sheet material conveying device in the copying machine of FIG. 1.

Now, the sheet material conveying device 60 will be described in detail. With reference to FIG. 2, the sheet material conveying device 60 includes the feed roller assembly 62, the temporary hampering means 64 and the guide plates 66 and 68 disposed therebetween, as stated above.

The distance t between the guide plates 66 and 68 defining a passage for the sheet material is relatively small, and is 2.0 to 15.0 mm, preferably 3.0 to 6.0 mm. As will be stated hereinbelow, if the distance t between the guide plates 66 and 68 is sufficiently small, the formation of creases and jamming between the feed roller assembly 62 and the temporary hampering means 64 can be fully avoided, even when the sheet material has a low degree of stiffness.

Figure 3:
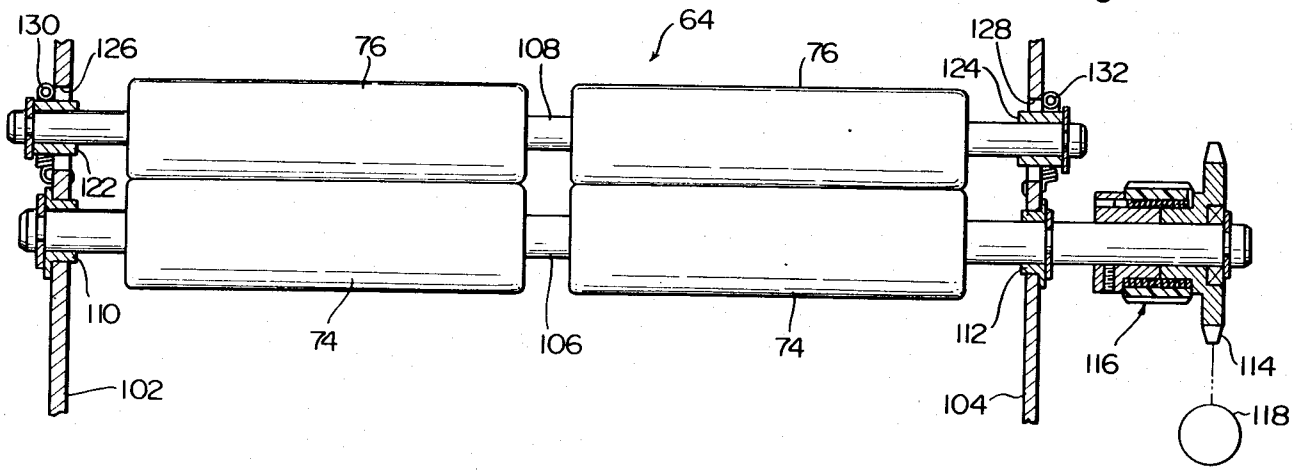
FIG. 3 is a sectional view showing a temporary hampering means in the sheet material conveying device of FIG. 2.

The temporary hampering means 64 in the illustrated embodiment is conventional. With reference to FIG. 3 together with FIG. 2, a pair of upstanding support walls 102 and 104 are disposed in spaced-apart relationship in the housing 2 (FIG. 1) in the front-rear direction (the direction perpendicular to the sheet surface in FIG. 1). The temporary hampering means 64 includes a driven shaft 106 and a follower shaft 108 extending across the pair of upstanding support walls 102 and 104. The driven shaft 106 is rotatably mounted on the upstanding support walls 102 and 104 via bearing members 110 and 112, and extends substantially horizontally. Two rollers 74 described hereinabove are fixed to the driven shaft 106 with some space between them in the axial direction. The driven rollers 74 can be made of a suitable metallic or plastic material. One end portion of the driven shaft 106 projects beyond the upstanding support wall 104, and to this one end portion are mounted a sprocket wheel 114 rotatably and a conventional spring clutch 116 for selectively linking the sprocket wheel 114 and the driven shaft 106. The sprocket wheel 114 is drivingly connected to a driving source 118 which may be an electric motor via a suitable drivingly connecting means (not shown), and while the driving source 118 is energized, the sprocket wheel 114 is continously rotated. When the clutch 116 is rendered operative, the sprocket wheel 114 is connected to the driven shaft 106. As a result, the driven shaft 106 and the follower roller 74 fixed thereto are rotated in the direction of an arrow 120 (FIG. 2). When the clutch 116 is rendered inoperative, the connection between the sprocket wheel 114 and the driven shaft 106 is cancelled, and the rotation of the driven shaft 106 and the driven roller 74 fixed to it is stopped. Bearing members 122 and 124 are mounted on the opposite end portions of the follower shaft 108 located above the driven shaft 106. Elongated holes 126 and 128 extending perpendicularly to the driven shaft 106 are formed in the upstanding support walls 102 and 104, and the bearing members 122 and 124 are positioned in the holes 126 and 128. Thus, the follower shaft 108 is mounted on the upstanding support walls 102 and 104 so that it can rotate freely and move freely toward and away from the driven shaft 106. Two follower rollers 76 described hereinabove are fixed to the follower shaft 108 at positions corresponding to the two driven rollers 74. If desired, instead of, or in addition to, mounting the follower shaft 108 rotatably, the follower rollers 76 may be mounted rotatably on the follower shaft 108. The follower rollers 76 can be made of a suitable plastic or metallic material. Suitable spring members 130 and 132 are provided in relation to the bearing members 122 and 124 mounted on the follower shaft 108. These spring members 130 and 132 elastically bias the follower shaft 108 toward the driven shaft 106 and thus press the follower rollers 76 against the driven rollers 74.

Now, with reference to FIGS. 2 and 4, the feed roller assembly 62 having the unique structure in accordance with this invention will be described. In the illustrated embodiment, the feed roller assembly 62 includes a driven shaft 134 and a follower shaft 136 extending across the pair of upstanding support walls 102 and 104. The driven shaft 134 is mounted rotatably on the upstanding support walls 102 and 104 via bearings 138 and 140 and extends substantially horizontally. One end portion of the driven shaft 134 projects beyond the upstanding support wall 104, and a gear 143 is fixed to this one end portion. The gear 142 is drivingly connected to the driving source 118 through a suitable drivingly connecting means (not shown). Accordingly, while the driving source 118 is energized, the gear 142 and the driven shaft 134 to which it is fixed are continuously rotated in the direction of an arrow 144 (FIG. 2).

The driven rollers 70 described above are mounted on the driven shaft 134. It is critical that the driven rollers 70 include at least one positively driven roller and at least one negatively driven roller, as defined above. In the illustrated embodiment, the driven rollers 70 include two centrally (axially inwardly) positioned positively driven rollers 70a and four negatively driven rollers 70b. Preferably, the positively driven rollers 70a and the negatively driven rollers 70b are made of a comparatively light material, for example a plastic material such as a polyacetal resin. To the driven shaft 134 are fixed four axially spaced rings 146, 148, 150 and 152. One positively driven roller 70a and two negatively driven rollers 70b are mounted between the rings 146 and 148. Likewise, one positively driven roller 70a and two negatively driven rollers 70b are mounted between the rings 150 and 152. It is critical that each of the negatively driven rollers 70b has a larger inside diameter $D_2$ than the outside diameter d of the driven shaft 134, and is mounted rotatably on the driven shaft 134. On the other hand, it is critical that each of the positively driven rollers 70a are mounted on the driven shaft so as to be positively rotated incident to the rotation of the driven shaft 134. With reference to FIG. 5 as well as FIG. 4, in the illustrated embodiment, the outside diameter of each of the positively driven rollers 70a is substantially the same as the outside diameter of the negatively driven rollers 70b, but the inside diameter $D_1$ of each of the positively driven rollers 70a is larger than the outside diameter d of the driven shaft 134 and slightly larger than the inside diameter $D_2$ of each of the negatively driven rollers 70b. Hence, the radial thickness of the positively driven rollers 70a is made slightly smaller than the radial thickness of the negatively driven rollers 70b. Cooperatively acting means for transmitting in cooperation the rotation of the driven shaft 134 positively to the positively driven rollers 70a are provided in the driven shaft 134 and the positively driven rollers 70a. Specifically, as shown in FIGS. 4 and 5, those parts of the driven shaft 134 on which the positively driven rollers 70a are mounted have fixed thereto at least one pin 154 extending diametrically through the driven shaft 134 (in the drawing, two pins 154 are spaced from each other axially of the driven shaft 134). The two ends of each pin 154 project beyond the outside surface of the driven shaft 134, and thus two protruding portions 156 diametrically opposing each other (the two end portions 156 of the pin 154) exist on the outside surface of the driven shaft 134. Depressed portions 158 extending continuously in the axial direction are formed at two diametrically opposing parts of the inside surface of the positively driven roller 70a so that they correspond to the protruding portions 156. Conveniently, the end surface of the protruding portion 156 and the bottom surface of the depressed portion 158 both have a hemispherical sectional shape. Each of the protruding portions 156 is positioned within a respective one of the depressed portions 158. When the driven shaft 134 is rotated in the direction shown by an arrow 144 in FIG. 5, the positively driven rollers 70a are positively rotated in the direction of arrow 144 by the cooperative action of the protruding portions 156 and the depressed portion 158.

Further with reference to FIG. 5, in the illustrated embodiment, the difference between the length L between the bottom surfaces of the two depressed portions 158 diametrically opposed to each other and the length l between the two protruding portions 156 diametrically opposed to each other, L–l, is made slightly smaller than the difference between the inside diameter $D_1$ of each positively driven roller 70a and the outside diameter d of the driven shaft 134, $D_1-d$ ($L-l<D_1-d$, and therefore $(L-l/2)<(D_1-d/2)$). The difference between the circumferential width of each depressed portion 158 and the circumferential width w of each protruding portion 156, $W-w$, is slightly larger than the difference $L-l(W-w>L-l$, and therefore, $$\frac{W-w}{2} > \frac{L-l}{2})$$

and is substantially equal to, or slightly smaller than, the difference $D_1-d(D_1-d>W-w>L-l$, and therefore $$\frac{D_1-d}{2} > \frac{W-w}{2} > \frac{L-l}{2}).$$

Figure 6:
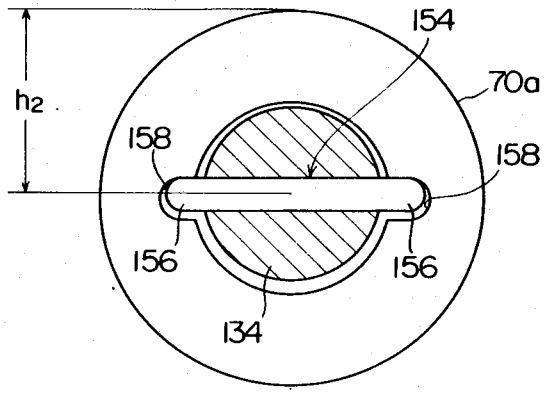
FIG. 6 is a sectional view showing the positively driven roller in the feed roller assembly of FIG. 4 as it is displaced to its lowermost position.
Figure 8:
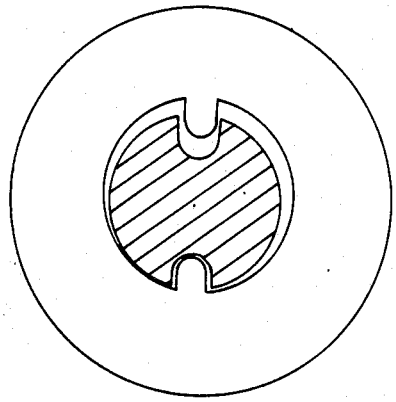
Figure 9:
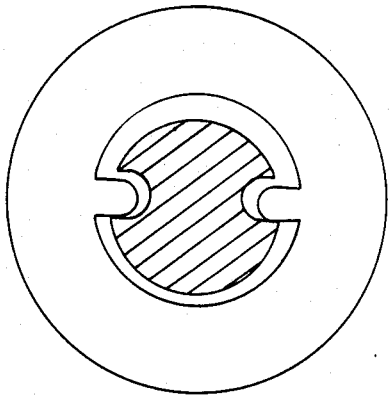

It will be readily understood that the positively driven rollers 70a are biased downwardly owing to their own weight. Accordingly, when the driven shaft 134 and the driven rollers 70a are at the angular position shown in FIG. 5, the bottom surface of the depressed portion 158 located above makes contact with the end surface of the protruding portion 156 located above, and the upper end of each positively driven roller 70a exists at a height $h_1$ from the central axis of the driven shaft 134. When the driven shaft 134 and the positively driven rollers 70a have rotated through 90 degrees from the angular position shown in FIG. 5 in the direction of arrow 144 and assume the angular position shown in FIG. 6, the side surface of the depressed portion 158 contacts the side surface of the protruding portion 156, and the upper end of each positively driven roller 70a exists at a height $h_2$ from the central axis of the driven shaft 134. As stated above, the difference $W-w$ is larger than the difference $L-l(W-w>L-l)$, and therefore, the height $h_1$ is larger than the height $h_2(h_1>h_2)$. Accordingly, in the course of the rotation of the driven shaft 134 and the positively driven rollers 70a from the angular position shown in FIG. 5 to the angular position shown in FIG. 6, the positively driven rollers 70a are displaced gradually downwardly with respect to the driven shaft 134, and the height of the upper end of each positively driven roller 70a from the central axis of the driven shaft 134 decreases from $h_1$ to $h_2$. When the driven shaft 134 and the positively driven rollers 70a further rotate through 90 degrees from the angular position shown in FIG. 6 in the direction of arrow 144, they again assume the angular position shown in FIG. 5, and during this 90 degree rotation, the positively driven rollers 70a are displaced gradually upwardly with respect to the driven shaft 134, and the height of the upper end of each positively driven roller 70a from the central axis of the driven shaft 134 increases from $h_2$ to $h_1$. Thus, in the illustrated embodiment, the positively driven rollers 70a alternately ascend and descend twice every time the driven shaft 134 and the positively driven rollers 70 are rotated through one revolution (360 degrees). If desired, the protruding portions 156 and the depressed portions 158 are provided only at a single angular position so that every time the driven shaft 134 and the positively driven rollers 70a are rotated through one revolution, the positively driven rollers 70a ascend and descend once with respect to the driven shaft 134. In still another embodiment, three or more protruding portions 156 and depressed portions 158 may be provided at circumferentially spaced positions so that every time the driven shaft 134 and the positively driven rollers 70a are rotated through one revolution, the positively driven rollers 70*a* alternately ascent and descend three or more times. If desired, it is possible to provide the protruding portions on the inner surfaces of the positively driven rollers 70*a* and the depressed portions on the outside surface of the driven shaft 134, as shown in FIGS. 8 and 9. Preferably, the height, $h_1$, of the upper end of each positively driven roller 70*a* from the central axis of the driven shaft 134 is substantially equal to the height, h, of the upper end of each negatively driven roller 70*b* from the central axis of the driven shaft 134 ($h_1=h$) when the positively driven rollers 70*a* have ascended to the highest position with respect to the driven shaft 134, namely at the position shown in FIG. 5. It will be readily appreciated that the negatively driven rollers 70*b* are not substantially displaced upwardly and downwardly with respect to the driven shaft 134 and therefore, their heights, h, are substantially the same.

Figure 4:
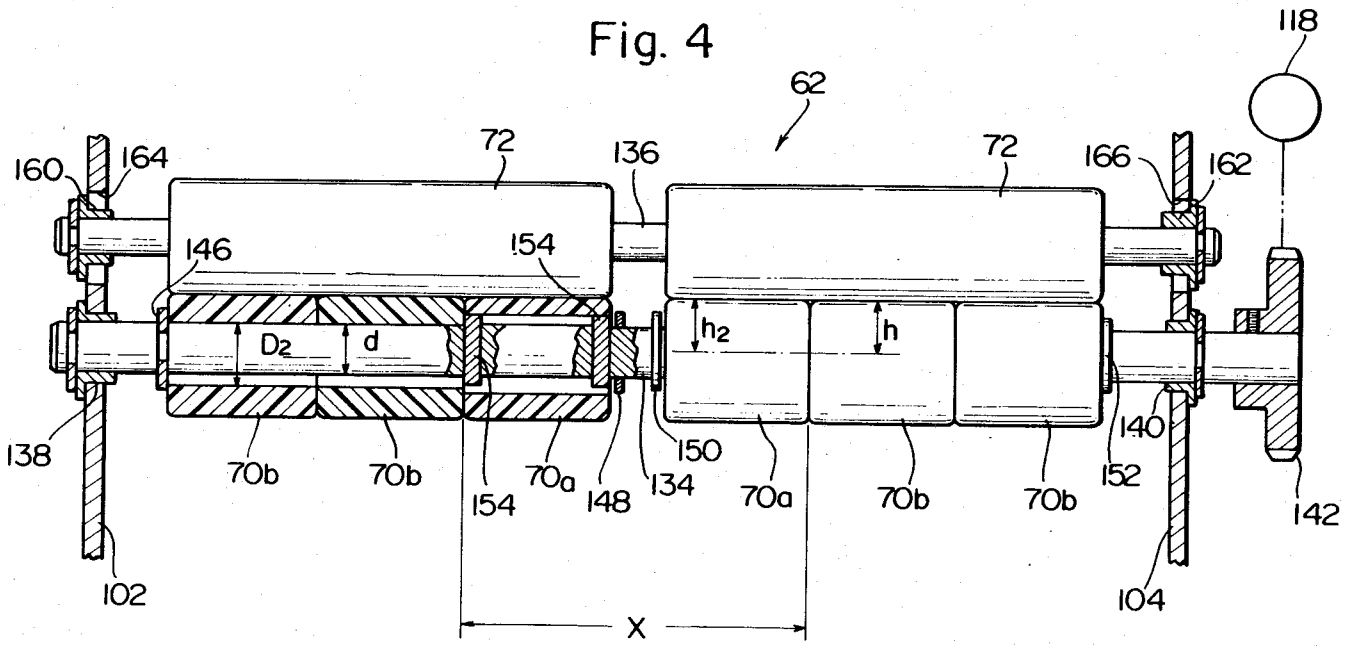
FIG. 4 is a sectional view showing a feed roller assembly in the sheet material conveying device of FIG. 2.
Figure 5:
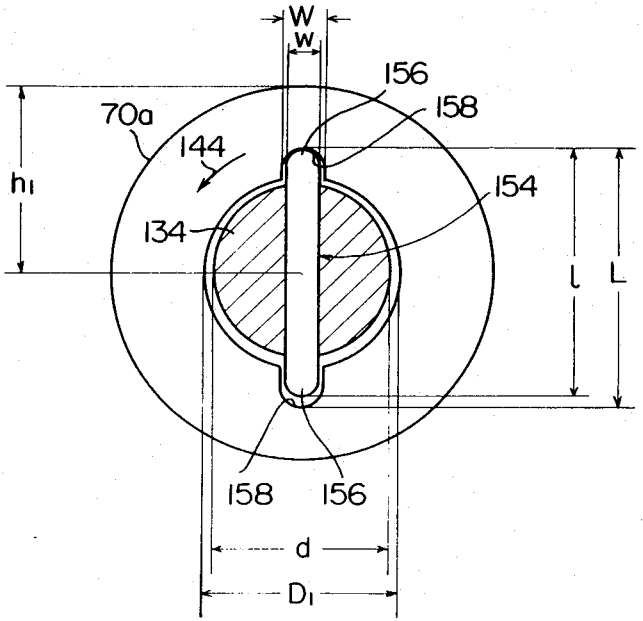
FIG. 5 is a sectional view showing a positively driven roller in the feed roller assembly of FIG. 4 as it is displaced to its uppermost position.

As can be seen from FIG. 4, the movement of the positively driven rollers 70*a* and the negatively driven rollers 70*b* in the axial direction of the driven shaft 134 is hampered by the rings 146, 148, 150 and 152. The axial width X defined by the two positively driven rollers 70*a* located centrally (axially inwardly) is made smaller than the width of a sheet material having the narrowest width among those sheet materials which are delivered to the feed roller assembly 62. Accordingly, it is desirable that all sheet materials sent to the feed roller assembly 62 should, without fail, undergo not only the action of the positively driven rollers 70 but also the action of the negatively driven rollers 70*b*.

With reference to FIG. 4 again, bearing members 160 and 162 are mounted on the opposite end portions of the follower shaft 136 located above the driven shaft 134. Elongated holes 164 and 166 extending perpendicularly to the driven shaft 134 are formed in the upstanding support walls 102 and 104, and the bearing members 160 and 162 are positioned in the holes 164 and 166. Thus, the follower shaft 136 is mounted on the upstanding support walls 102 and 104 so that it can be rotated freely and move freely toward and away from the driven shaft 134. Two follower rollers 72 described are fixed to the follower shaft 136. One of the rollers 72 is located at a position corresponding to the three driven rollers 70*a* and 70*b* located between the rings 146 and 148. The other roller 72 is located at a position corresponding to the three driven rollers 70*a* and 70*b* located between the rings 150 and 152. If desired, instead of, or in addition to, mounting the follower shaft 136 rotatably, the follower rollers 72 can be rotatably mounted on the follower shaft 136. The follower rollers 72 may be formed of a metallic or plastic material. The follower rollers 72 are pressed against the driven rollers 70 by their own weight and the weight of the follower shaft 136. If desired, it is possible to bias elastically the follower shaft 136 toward the driven shaft 134 by a suitable spring member and thus press the follower rollers 72 against the driven rollers 70.

Now, with reference to FIGS. 2 to 6, particularly FIG. 2, the operation of the sheet material conveying device 60 described above will be described. When the leading edge of a sheet material S manually delivered from the manual sheet material delivering means 40 (FIG. 1) reaches the nipping position between the driven rollers (i.e., the positively driven rollers 70*a* and the negatively driven rollers 70*b*) and the follower rollers 72 in the feed roller assembly 62, the driven rollers 70 and the follower rollers 72 nip and feed the sheet material S. Since at this time the follower rollers 72 are pressed against the negatively driven rollers 70*b* by the weights of the follower rollers 72 and the follower shaft 136, the inner circumferential surfaces of the negatively driven rollers 70*b* are pressed against the outer circumferential surface of the driven shaft 134 at a site shown by A in FIG. 2 and therefore at the site A, a frictional force FA is generated between the inner circumferential surfaces of the negatively driven rollers 70*b* and the outer circumferential surface of the driven shaft 134. Hence, the rotation of the driven shaft 134 being continuously rotated is transmitted to the positively driven rollers 70*a* via the protruding portions 156 and the depressed portions 158 and also to the negatively driven rollers 70*b* through the frictional force FA. As a result, the positively driven rollers 70*a* and the negatively driven rollers 70*b* are rotated in the direction of arrow 144. The sheet material S is thus fed in the direction of an arrow 168 mainly by the action of the negatively driven rollers 70*b*, and the follower rollers 72 are rotated in the direction of an arrow 170. As stated above, the positively driven rollers 70*a* alternately ascend and descend twice during one rotation, and when they have ascended to the highest position (the position shown in FIGS. 4 and 5), the height $h_1$ of the upper end of each positively driven roller 70*a* becomes substantially equal to the height, h, of the upper end of each negatively driven roller 70*b*. Hence, the positively driven rollers 70*a* temporarily act on the sheet material S when they have ascended to the highest position (twice in one rotation).

The sheet material S fed by the feed roller assembly 62 is passed between the guide plates 66 and 68 and conducted to the nipping position between the driven rollers 74 in the inoperative state and the follower rollers 76. Then, the leading edge of the sheet material S abuts against the nipping position between the driven rollers 74 in the inoperative state and the follower rollers 76. As a result, when the sheet material S has relatively high stiffness, the entire sheet material S is stopped, owing to its relatively high stiffness, as shown by the solid line in FIG. 2 without substantial bending. On the other hand, when the sheet material S has relatively low stiffness, the sheet material S continues to be fed for some time by the action of the feed roller assembly 62 even after its forward movement has been hampered by the temporary hampering means 64. For this reason, the sheet material S is bent between the temporary hampering means 64 and the feed roller assembly 62 as shown by the two-dot chain line in FIG. 2. Since, however, the distance t between the guide plates 66 and 68 is made relatively small, when the sheet material S is slightly bent, it contacts both the lower guide plate 66 and the upper guide plate 68. Consequently, further bending of the sheet material S is impeded, and the apparent stiffness of the sheet material S is increased. Accordingly, no undesirable creases are formed in the sheet material S and the entire sheet is stopped.

When the entire sheet material S is stopped as shown above, the rotation of the follower rollers 72 in the feed roller assembly 62 is necessarily stopped. Furthermore, the sheet material resists the rotation of the negatively driven rollers 70*b* in the feed roller assembly 62, and thus, a frictional force FB is generated between the lower surface of the sheet material S and the outer circumferential surfaces of the negatively driven rollers 70*b* at a side shown by B in FIG. 2. The frictional force FB becomes greater than the frictional force FA generated between the inner circumferential surfaces of the negatively driven rollers 70*b* and the outer circumferential surface of the driven shaft 134. Consequently, the rotation of the negatively driven rollers 70*b* is stopped in spite of the fact that the driven shaft 134 is kept rotating. This leads to an accurate avoidance of the undesirable phenomenon occurring in the conventional feed roller assembly, namely the phenomenon of soiling of the lower surface of the sheet material which is caused by the continuous maintenance of a slipping condition between the sheet material at stoppage and the negatively driven rollers 70*b*.

On the other hand, the positively driven rollers 70*a* are kept rotating because the rotation of the driven shaft 134 is positively transmitted to the positively driven rollers 70*a* by the cooperative action of the protruding portions 156 and the depressed portions 158. However, the positively driven rollers 70*a* act only temporarily on the sheet material S when they have ascended to the highest position (twice during one rotation), and therefore, a slipping condition is generated between the sheet material S at stoppage and the positively driven rollers 70*a* temporarily twice during one rotation of the positively driven rollers 70*a*. Accordingly, the soiling of the lower surface of the sheet material S by the rotation of the positively driven rollers 70*a* will be only slight.

It might be possible to construct the positively driven rollers 70*a* in the same structure as the negatively driven rollers, or in other words to construct all of the driven rollers 70 as negatively driven rollers, in order to circumvent sufficiently the soiling of the lower surface of the sheet material S. The experience of the present inventors tells, however, that the following problems arises when all of the driven rollers 70 are adapted to be negatively driven. Specifically, such a structure provides only an insufficient action of causing the leading end of the sheet material S to abut against the nipping position between the driven rollers 74 in the inoperative state and the follower rollers 76. Consequently, any inclination of the sheet material S (when the leading edge of the sheet material S is not substantially perpendicular, but inclined, to the conveying direction 156) cannot be properly corrected. Or when the rotation of the driven rollers 74 is started later, some delay tends to occur in conveying the sheet material S in the direction of arrow 168 by the driven rollers 74 and the follower rollers 76 (this delay produces an error in the synchronism of the rotation of the rotating drum 10 with the conveying of the sheet material S). However, when the driven rollers 70 in the feed roller assembly 62 include positively driven rollers 70*a*, the positively driven rollers 70*a* continue to rotate after the rotation of the negatively driven rollers 70*b* has been stopped. Thus, the positively driven rollers 70*a* intermittently (twice during one rotation) act on the sheet material S, and the above tendency ca be fully circumvented.

After the sheet material S has been stopped as above, the clutch means 116 in the temporary hampering means 64 is rendered operative in synchronism with the rotation of the rotating drum 10 (FIG. 1), and the driven rollers 74 begin to rotate in the direction of arrow 120. As a result, the conveying of the sheet material S is resumed and it is conveyed in the direction of arrow 168. The follower rollers 76 are rotated in the direction of arrow 172. When the sheet material S begins to be conveyed in the direction of arrow 168, the negatively driven rollers 70*b* and the follower rollers 72 in the feed roller assembly 62 begin rotation in the directions of arrows 144 and 170.

In the sheet material conveying device 60, the temporary hampering means 64 includes the driven rollers 74 to be selectively rotated and the follower rollers 76, and has the function of not only hampering the forward movement of the sheet material S temporarily but also positively conveying it. When, for example, the temporary hampering means 64 needs to have only the function of temporarily hampering the forward movement of the sheet material S, it may be constructed of a suitable stopping member which is adapted to be selectively held at an operating position at which it projects into the conveying path of the sheet material S and hampers the forward movement of the sheet material S and at a non-operating position at which it moves away from the conveying path of the sheet material S and permits forward movement of the sheet material S.

In the illustrated copying apparatus, the sheet material conveying device 60 is provided in relation to the manual sheet material delivering device 40, and only the temporary hampering means 64 in the sheet material conveying device 60 effectively acts on the automatic sheet material delivering means 38. However, when the length of the conveying path of the sheet material from the automatic sheet material delivering means 38 to the temporary hampering means 64 is relatively large and a feed means must be disposed between them, it is possible to use the same feed roller assembly 62 as such a feed means and in relation to it, use a pair of the same guide plates such as the plates 66 and 68.

Figure 7:
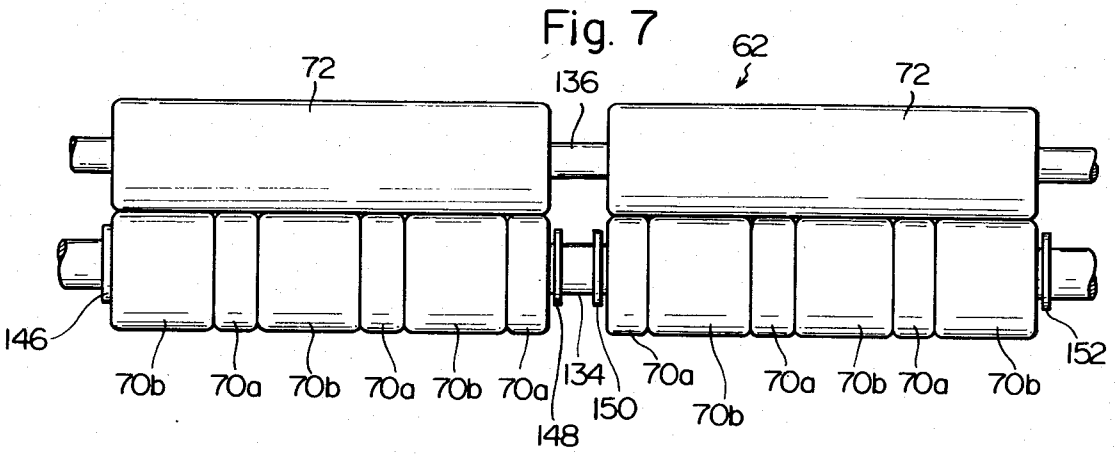
FIG. 7 is a partial front elevation showing a modified example of the feed roller assembly.

FIG. 7 shows a modified example of the feed roller assembly 62. In the modified example shown in FIG. 7, six positively driven rollers 70*a* and six negatively driven rollers 70*b* are mounted on the driven shaft 134. More specifically, three positively driven rollers 70*a* having a relatively small axial dimension are mounted alternately with three negatively driven rollers 70*b* between the rings 146 and 148. Likewise, between the rings 150 and 152, three positively driven rollers 70*a* having a relatively small axial dimension are mounted alternately with three negatively driven rollers 70*b*. The structures and actions of the positively driven rollers 70*a* and the negatively driven rollers 70*b* can be substantially the same as those of the positively driven rollers 70*a* and the negatively driven rollers 70*b* shown in FIGS. 4 to 6.

If desired, in order to distribute axially a plurality of areas where soiling can occur, a plurality of positively driven rollers having a relatively small axial width may be arranged alternately with the negatively driven rollers as shown, for example, in the modified example in FIG. 7.

The structures other than those described above of the modified examples shown in FIG. 7 may be substantially the same as those of the feed roller assembly 62 shown in FIGS. 2 to 6.

While the present invention has been described in detail hereinabove with regard to some specific embodiments of the sheet material conveying device constructed in accordance with this invention taken in conjunction with the accompanying drawings, it should be understood that the invention is not limited to these specific embodiments, and various changes and modifications are possible without departing from the scope of the invention.

What is claimed is:

1. In a paper sheet material conveying device for feeding paper sheets in an electrostatic copying machine, said conveying device being of the type comprising a feed roller assembly for feeding the paper sheets in a feed direction and temporary hampering means, located downstream of said feed roller assembly with respect to said feed direction, for temporarily stopping forward movement of a paper sheet being fed by said feed roller assembly, said feed roller assembly comprising a driven shaft extending substantially horizontally, means for continuously rotating said driven shaft, a follower shaft extending substantially horizontally at a position above said driven shaft, and at least one follower roller mounted on said follower shaft, said driven rollers and said follower roller rotating and nipping therebetween a paper sheet during feeding thereof by said feed roller assembly, and the paper-sheet, upon being stopped temporarily by said hampering means, preventing rotation of said follower roller, the improvement comprising means for, upon the paper sheet being stopped by said hampering means, reducing soiling of the paper sheet without interruption of the continuous rotation of said driven shaft, said reducing means comprising:

said plurality of driven roller comprising at least one first driven roller having a non-slip rotary connection with said driven shaft and at least one second driven roller having an inside diameter larger than the outside diameter of said driven shaft and mounted on said driven shaft with a rotary slip connection therebetween, said non-slip rotary connection comprising means for displacing said first driven roller upwardly and downwardly with respect to said driven shaft during each revolution thereof between an upper position, whereat the uppermost surface of said first driven roller is at substantially the same level as the uppermost surface of said second driven roller, and a lower position below said level; and said first and second driven rollers contacting the paper sheet and cooperating with said follower roller to nip therebetween the paper sheet during feeding thereof;

whereby when feeding of the paper sheet is stopped temporarily by said hampering means, rotating of said at least one second driven roller is interrupted during continued rotation of said driven shaft due to said rotary slip connection therebetween, while rotating of said at least one first driven roller is continued during continued rotation of said driven shaft due to said non-slip rotary connection therebetween.

2. The improvement claimed in claim 1, wherein said first driven roller has an inner diameter larger than said inside diameter of said second driven roller, and said displacing means comprises means acting between said driven shaft and said first driven roller for transmitting rotation of said driven shaft to said first driven roller while enabling downward displacement of said first driven roller due to the weight thereof with respect to said driven shaft.

3. The improvement claimed in claim 2, wherein said displacing means comprises at least one protrusion extending from one of the outer surfaces of said driven shaft or the inner surface of said first driven roller, and at least one depression extending into the other of said inner surface of said first driven roller or said outer surface of said driven shaft, said protrusion extending into said depression.

4. The improvement claimed in claim 3, comprising two said protrusions extending from said outer surface of said driven shaft at positions diametrically opposite each other, and two said depressions extending into said inner surface of said first driven roller at positions diametrically opposite each other.

5. The improvement claimed in claim 4, wherein the dimension between radially outer ends of said depressions is greater than the dimension between radially outer ends of said protrusions.

6. The improvement claimed in claim 1, wherein said follower shaft is mounted so as to freely move toward any away from said driven shaft, and said follower roller is pressed against said driven rollers by the weights of said follower shaft and said follower roller mounted thereon.

7. The improvement claimed in claim 1, wherein said first and second driven rollers are formed of material having a relatively low coefficient of friction.

8. The improvement claimed in claim 7, wherein said material comprises plastic.

9. The improvement claimed in claim 1, further comprising a pair of guide plates defining therebetween a paper sheet feeding path and positioned between said feed roller assembly and said temporary hampering means, said plates being spaced by a distance of from 2.0 mm to 15.0 mm.

10. The improvement claimed in claim 9, wherein said distance is from 3.0 mm to 6.0 mm.

* * * * *

UNITED STATES PATENT AND TRADEMARK OFFICE

CERTIFICATE OF CORRECTION

PATENT NO. : 4,678,178

DATED : July 7, 1987

INVENTOR(S) : Kazunori AKIYAMA et al.

It is certified that error appears in the above-identified patent and that said Letters Patent is hereby corrected as shown below:

Column 13, line 11, after "shaft," insert --a plurality of driven rollers mounted on said driven shaft,--.

Signed and Sealed this

Second Day of February, 1988

*Attest:*

DONALD J. QUIGG

*Attesting Officer*

*Commissioner of Patents and Trademarks*